US008883045B2

(12) United States Patent
Hosoya et al.

(10) Patent No.: US 8,883,045 B2
(45) Date of Patent: Nov. 11, 2014

(54) METAL NANOWIRE-CONTAINING COMPOSITION, AND TRANSPARENT CONDUCTOR

(75) Inventors: Yoichi Hosoya, Kanagawa (JP); Naoharu Kiyoto, Kanagawa (JP); Nori Miyagishima, Kanagawa (JP); Takeshi Funakubo, Kanagawa (JP); Kenji Naoi, Kanagawa (JP); Ryoji Nishimura, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 789 days.

(21) Appl. No.: 12/570,143

(22) Filed: Sep. 30, 2009

(65) Prior Publication Data

US 2010/0078602 A1 Apr. 1, 2010

(30) Foreign Application Priority Data

Sep. 30, 2008 (JP) ..... 2008-252744

(51) Int. Cl.
*H01B 1/02* (2006.01)
*H01B 1/22* (2006.01)

(52) U.S. Cl.
CPC ..... *H01B 1/22* (2013.01); *Y10S 977/762* (2013.01); *Y10S 977/932* (2013.01)
USPC ..... 252/512; 252/500; 252/514; 528/373; 528/423; 977/762; 977/932

(58) Field of Classification Search
USPC ..... 252/500–521.6, 512, 514; 423/445 R–447.3; 528/373, 423; 977/762, 932
See application file for complete search history.

(56) References Cited

U.S. PATENT DOCUMENTS

| | | | | |
|---|---|---|---|---|
| 2004/0238367 | A1* | 12/2004 | Penner et al. | 205/76 |
| 2005/0209388 | A1* | 9/2005 | Hsu et al. | 524/457 |
| 2006/0115536 | A1* | 6/2006 | Yacaman et al. | 424/489 |
| 2007/0074316 | A1 | 3/2007 | Alden et al. | |
| 2008/0259262 | A1* | 10/2008 | Jones et al. | 349/139 |
| 2009/0053126 | A1* | 2/2009 | Lee et al. | 423/350 |
| 2009/0056589 | A1* | 3/2009 | Guiheen et al. | 106/285 |
| 2009/0129004 | A1* | 5/2009 | Gruner | 361/679.21 |
| 2009/0239338 | A1* | 9/2009 | Zhou et al. | 438/108 |

FOREIGN PATENT DOCUMENTS

| | | |
|---|---|---|
| JP | 2005-317395 | 10/2005 |
| WO | 2007022226 | 2/2007 |

OTHER PUBLICATIONS

JP Office Action dated Mar. 13, 2012, with English Translation, Application No. 2008-252744.

* cited by examiner

*Primary Examiner* — Tri V Nguyen
(74) *Attorney, Agent, or Firm* — Young & Thompson

(57) ABSTRACT

The present invention provides a metal nanowire-containing composition containing at a least metal nanowire and a heterocyclic compound having an interaction potential of less than −1 mV.

6 Claims, 1 Drawing Sheet

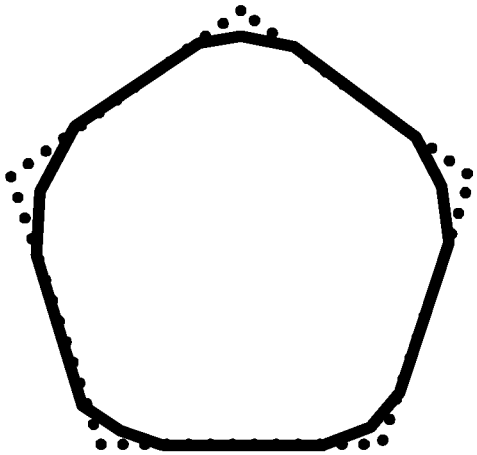

METAL NANOWIRE-CONTAINING COMPOSITION, AND TRANSPARENT CONDUCTOR

BACKGROUND OF THE INVENTION

1. Field of the Invention

The present invention relates to a metal nanowire-containing composition excellent in thermal stability, and a transparent conductor using the metal nanowire-containing composition.

2. Description of the Related Art

A variety of studies have been made on conductive materials using metal nanowires. For instance, there has been proposed in U.S. Patent Application Publication No. 2007/0074316 a transparent conductor using metal nanowires. Also, there has been proposed in Japanese Patent Application Laid-Open (JP-A) No. 2005-317395 a conductor paste containing metal nanowires.

In these proposals, however, forming of nano-structured metals causes the metals to be thermally unstable, and it is desired to improve the thermal stability of nano-structured metals.

BRIEF SUMMARY OF THE INVENTION

An object of the present invention is to provide a metal nanowire-containing composition which is improved in thermal stability, without impairing its excellent transparency, conductivity and durability, and to provide a transparent conductor using the metal nanowire-containing composition.

The following are means for solving the aforesaid problems:

<1> A metal nanowire-containing composition containing at least a metal nanowire, and a heterocyclic compound having an interaction potential of less than −1 mV.

<2> The metal nanowire-containing composition according to <1>, wherein the metal nanowire has a diameter of 50 nm or less and a length of 5 μm or longer, and the metal nanowire is contained in an amount, as metal, of 50% by mass or more in the total amount of metal particles.

<3> The metal nanowire-containing composition according to one of <1> and <2>, wherein the metal nanowire contains silver.

<4> The metal nanowire-containing composition according to any one of <1> to <3>, further containing an aqueous solvent, and being in the form of an aqueous dispersion.

<5> A transparent conductor having a transparent conductive layer which contains a metal nanowire-containing composition, wherein the metal nanowire-containing composition contains at least a metal nanowire, and a heterocyclic compound having an interaction potential of less than −1 mV.

<6> The transparent conductor according to <5>, used in one of a touch panel and a solar cell panel.

According to the present invention, it is possible to solve the problems pertinent in the related art and to provide a metal nanowire-containing composition which is improved in thermal stability, without impairing its excellent transparency, conductivity and durability, and to provide a transparent conductor using the metal nanowire-containing composition.

BRIEF DESCRIPTION OF THE DRAWING

FIG. 1 is an illustration showing how to determine a degree of sharpness of metal nanowire.

DETAILED DESCRIPTION OF THE INVENTION

Metal Nanowire-Containing Composition

A metal nanowire-containing composition according to the present invention contains at least a metal nanowire and a heterocyclic compound, and further contains other components in accordance with the necessity.

<Metal Nanowire>

The metal nanowire has a diameter of 50 nm or smaller and a length of 5 μm or longer, and the metal nanowire having such a diameter and such a length is contained in an amount of metal of 50% by mass or more in the total amount of metal particles.

In the present invention, the term "metal nanowire(s)" means a metal nanowire or metal nanowire particles having an aspect ratio (length/diameter) of 30 or more.

The diameter (minor axis length) of the metal nanowire is preferably 50 nm or smaller, more preferably 35 nm or smaller, still more preferably 20 nm or smaller. When the diameter is excessively small, the resistance to oxidation and the durability of the metal nanowire may degrade. Thus the diameter is preferably 5 nm or larger. When the diameter is larger than 50 nm, it may be impossible to obtain sufficient transparency due to scattering which is presumed to be attributable to the metal nanowire. The length (major axis length) of the metal nanowire is preferably 5 μm or longer, more preferably 10 μm or longer, still more preferably 30 μm or longer. When the major axis length of the metal nanowire is excessively long, the metal nanowire particles may entangle to each other, and aggregates may occur in the course of production. Thus, the major axis length of the metal nanowire is preferably 1 mm or shorter. When the major axis length is shorter than 5 μm, it may be difficult to form a dense network, and so that it may be impossible to obtain sufficient conductivity.

The diameter and the major axis length of the metal nanowire can be determined, for example, by observing TEM images and optical microscopic images of the metal nanowire, which are taken by a transmission electron microscope (TEM) and an optical microscope. In the present invention, 300 particles of metal nanowire were observed through a transmission electron microscope (TEM) to determine each average value of diameters and major axis lengths, and from these average values, the diameter and the major axis length of the metal nanowire were determined.

In the present invention, it is preferable that a metal nanowire whose diameter (minor axis length) is 50 nm or smaller and whose length (major axis length) of 5 μm or longer be contained in an amount of metal of 50% by mass or more in the total amount of metal particles, more preferably contained in an amount of 60% by mass or more, still more preferably contained in an amount of 75% by mass or more.

When the rate of the amount of a metal nanowire whose diameter is 50 nm or smaller and whose length of 5 μm or longer (hereinafter, otherwise referred to as "appropriate wiring rate") is less than 50% by mass, the conductivity may degrade, which is presumed because the amount of metal contributing to the conductivity is reduced, and simultaneously, voltage concentration occurs due to impossibility of forming a dense network, thereby possibly leading to reduction in durability. Also, when particles other than nanowire particles have spherical shape or the like and strong plasmon absorption, the transparency of the metal nanowire may degrade.

Here, the appropriate wiring rate can be determined in the following manner. For instance, in the case where the metal nanowire is a silver nanowire, an aqueous dispersion liquid of the silver nanowire is filtered to separate silver nanowire particles from particles other then the silver nanowire particles, and the amount of Ag remaining on the paper filter and the amount of Ag passed through the paper filter are respectively measured by means of ICP (inductively coupled plasma) spectrometer, and thereby the appropriate wiring rate can be determined. The metal nanowire particles remaining on the paper filter are then observed by a transmission electron microscope (TEM), and diameters of 300 particles of metal nanowire are observed, and its particle size distribution is examined, thereby confirming that the metal nanowire is a metal nanowire having a diameter of 50 nm or smaller and a length of 5 μm or longer. As for the filter paper, firstly, the maximum major axis of particles other than particles of metal nanowire having a diameter of 50 nm or smaller and a length of 5 μm or longer is measured from the TEM image, and it is preferable to use a filter paper having a pore size about five times the maximum major axis length or larger and one-half the minimum minor axis length of the wire major axis or smaller.

The coefficient of variation in diameter of the metal nanowire of the present invention is preferably 40% or less, more preferably 35% or less, still more preferably 30% or less.

When the coefficient of variation in diameter is more than 40%, the voltage is liable to concentrate on wire particles of small diameter, possibly leading to degradation of durability.

As for the coefficient of variation in diameter of the metal nanowire, for instance, diameters of 300 particles of the metal nanowire are measured from transmission electron microscope (TEM) images, and the standard deviation and average value are calculated to thereby determine the coefficient of variation.

The metal nanowire of the present invention can be formed so as to take an arbitrary shape, for example, a cylindrical shape, and a columnar shape with a polygonal cross-section. In application where high transparency is required, preferably, the metal nanowire takes a cylindrical shape or has a polygonal cross-section whose angles (polygonal cross-section angles) being rounded off.

Specifically, an aqueous dispersion liquid of metal nanowire is applied onto a base material, and the cross-section of the metal nanowire can be identified by observation using a transmission electron microscope (TEM).

The wording "cross-section angles of metal nanowire" means outer circumferential portions of a polygonal cross-section, at individual points each intersecting with a line which is dropped off perpendicularly from adjacent two sides of the polygonal cross-section when individual sides of the cross-section are two-dimensionally extended. The wording "individual sides of the cross-section" is defined by straight lines each drawn from adjacent angles to each intersection. In this case, the rate of a length of "the outer circumferential portions of the cross-section" relative to a total length of "the individual sides of a polygonal cross-section" is defined as a degree of sharpness. The degree of sharpness can be represented, for example, in a cross-section of metal nanowire as illustrated in FIG. 1, by a ratio of the circumferential length of the cross-section indicated by a solid line to the circumferential length of the pentagon. A cross-sectional shape having a degree of sharpness of 75% or less is defined as a "cross-sectional shape having rounded angles". The degree of sharpness is preferably 60% or less, more preferably 50% or less. When the degree of sharpness is more than 75%, electrons locally exist at these angles to cause an increase in plasmon absorption, possibly leading to degradation in transparency of the metal nanowire, due to yellow-tinged residue or the like.

The metal used for the metal nanowire is not particularly limited and any metal may be used. For example, besides a single use of metal, a combination of two or more metals may be used, and may be used in the form of metal alloy. A metal nanowire formed of metal or a metal compound is preferable, and a metal nanowire formed of metal is more preferable.

The metal is preferably at least one selected from the group consisting of metal elements of the Period Group 4, Period Group 5 and Period Group 6 in the long-form periodic table (IUPAC 1991); more preferably at least one selected from the group consisting of metal elements of the Group 2 through Group 14, and still more preferably at least one selected from the group consisting of metal elements of the Group 2, and Groups 8 through 14. Particularly preferably, the metal nanowire contains these metals as the main component.

Specific examples of the metal include copper, silver, gold, platinum, palladium, nickel, tin, cobalt, rhodium, iridium, iron, ruthenium, osmium, manganese, molybdenum, tungsten, niobium, tantalum, titanium, bismuth, antimony, lead, and alloys thereof. Among these, preferred are copper, silver, gold, platinum, palladium, nickel, tin, cobalt, rhodium, iridium, and alloys thereof, more preferred are palladium, copper, silver, gold, platinum, tin and alloys thereof, and particularly preferred are silver and alloys containing silver.

<Method for Producing Metal Nanowire>

The method for producing a metal nanowire includes adding a metal complex solution into an aqueous solution containing at least a halogen compound and a reducing agent, and heating the resulting mixture at a temperature of 150° C. or lower, and further includes a desalination process.

The metal complex is not particularly limited and may be suitably selected in accordance with the intended use, however, a silver complex is particularly preferable. As ligands of the silver complex, for example, CN—, SCN—, $SO_3^2$, thiourea, and ammonia are exemplified. These silver complexes can be referred to the description in "The Theory of the Photographic Process 4$^{th}$ Edition" Macmillan Publishing, written by T. H. James. Among these silver complexes, a silver ammonia complex is particularly preferable. The metal complex is preferably added to the aqueous solution to which a dispersant and a halogen compound have been added. By doing so, the ratio of amount of metal nanowire particles having appropriate diameters and appropriate lengths can be effectively increased because of its high-probability of formation of wire nuclei.

The solvent is preferably a hydrophilic solvent. Examples of the hydrophilic solvent include alcohols such as methanol, ethanol, propanol, isopropanol, and butanol; ethers such as dioxane, and tetrahydrofuran; ketones such as acetone: and cyclic ethers such as tetrahydrofuran, and dioxane.

The heating temperature is preferably 150° C. or lower, more preferably 20° C. to 130° C., still more preferably 30° C. to 100° C., and particularly preferably 40° C. to 90° C. If necessary, the heating temperature may be varied in the course of forming particles. Varying the heating temperature in midstream may sometimes be effective in control of nuclei formation, prevention of occurrence of reproduced nuclei, and improvement of the monodispersibility attributable to acceleration of selective growth.

When the heating temperature is higher than 150° C., angles constituting the nanowire cross-section become acute, possibly leasing to a decrease in the transmittance in evaluation of the resulting coating film. Also, the lower the heating temperature is, the lower the probability of nuclei formation and the longer the metal nanowire is, and so that the metal nanowire particles easily entangle to each other, possibly leading to degradation in the dispersion stability. This tendency becomes conspicuous at a temperature of 20° C. or lower.

In the heating treatment, it is preferable to use a reducing agent. The reducing agent is not particularly limited, and may be suitably selected from among commonly used reducing agents. Examples thereof include metal salts of boron hydrides such as sodium boron hydride, and potassium boron hydride; aluminum hydride salts such as lithium aluminum hydride, potassium aluminum hydride, cesium aluminum hydride, beryllium aluminum hydride, magnesium aluminum hydride, and calcium aluminum hydride; sodium sulfites, hydrazine compounds, dextrin, hydroquinone, hydroxylamine, citric acids or salts thereof, succinic acids or salts thereof, and ascorbic acids or salts thereof, alkanol amines such as diethylaminoethanol, ethanolamine, propanolamine, triethanolamine, and dimethylamino-propanol; aliphatic amines such as propyl amine, butyl amine, dipropylene amine, ethylene diamine, and triethylene pentamine; heterocyclic amines such as piperidine, pyrrolidine, N-methylpyrrolidine, and morpholine; aromatic amines such as aniline, N-methyl aniline, toluidine, anisidine, and phenetidine; aralkyl amines such as benzylamine, xylenediamine, and N-methyl benzylamine; alcohols such as methanol, ethanol, and 2-propanol; ethylene glycol, glutathione, organic acids (e.g. citric acid, malic acid, tartaric acid, etc.); reducing sugars (e.g. glucose, galactose, mannose, fructose, sucrose, maltose, raffinose, stachyose, etc.), and sugar alcohols (sorbitol, etc.). Among these, reducing sugars, and sugar alcohols as derivatives thereof are particularly preferable.

Note that in some cases reducing agents can function as dispersants depending on the type thereof, and such reducing agents can be preferably used.

The addition of the reducing agent may be before or after the addition of a dispersant, and may be before or after the addition of a halogen compound.

In production of the metal nanowire, a halogen compound is preferably added to the metal nanowire-containing composition. The halogen compound is not particularly limited as long as it is a compound containing bromine, chlorine, and iodine, and may be suitably selected in accordance with the intended use. For example, alkali halides such as sodium bromide, sodium chloride, sodium iodide, potassium iodide, potassium bromide, potassium chloride, and potassium iodide; and substances to be used in combination with the following dispersants are preferred. The addition of the halogen compound may be before or after the addition of the dispersant, and may be before or after the addition of the reducing agent.

Note that in some cases halogen compounds can function as dispersants depending on the type thereof, and such halogen compounds can be preferably used.

Instead of the halogen compound, halogenated silver fine particles may be used, or halogenated silver fine particles may be used along with the halogen compound.

A combination of a dispersant in combination with a halogen compound or halogenated silver fine particles may be used as one compound. Examples of a compound composed of a dispersant in combination with a halogen compound include HTAB (hexadecyl-trimethyl ammonium bromide) which contains amino groups and bromide ions, and HTAC (hexadecyl-trimethyl ammonium chloride) which contains amino groups and bromide ions.

In production of the metal nanowire, it is preferable to add a dispersant to the metal nanowire-containing composition.

The dispersant is added before preparation of particles and may be added in the presence of a dispersion polymer, or may be added to control the dispersed condition after particles have been prepared. The addition process of the dispersant is divided into two or more steps, it is necessary to vary the addition amount of the dispersant depending on the required length of wire. This is considered to be attributable to a length of wire obtained by controlling the amount of metal particles to be nuclei.

As the dispersant, there may be exemplified amino group-containing compounds, thiol group-containing compounds, sulfide group-containing compounds, amino acids or derivatives thereof, peptide compounds, polysaccharides, and polymers such as natural polymers and synthetic polymers derived from polysaccharides, and gels derived therefrom.

The polymers are, for example, polymers having colloid-protection property. Examples of such polymers are gelatin, polyvinyl alcohol, methyl cellulose, hydroxypropyl cellulose, polyalkylene amine, partial alkyl esters of polyacrylic acids, polyvinyl pyrrolidone, and polyvinyl pyrrolidone copolymers.

Structures usable for the dispersant can be referred, for example, to the description in "*Ganryo no Jiten* (Pigment Dictionary)", Asakura Publishing Co., Ltd., edited by Seijiro Ito, 2000. The shape of the resulting metal nanowire can be changed depending on the type of dispersant used.

The desalination process can be performed by ultrafiltration, dialysis, gel filtration, decantation, centrifugal separation or the like, after metal nanowire have been formed.

<Heterocyclic Compound>

The heterocyclic compound preferably has an interaction potential of less than −1 mV, more preferably has an interaction potential of less than −70 mV. When the interaction potential is −1 mV or more, the thermal stability, which is an effect of the present invention, may not be obtained, and precipitation, etc. of the heterocyclic compound may be caused.

Here, the interaction potential can be determined by the following method.

Firstly, 50 mL of a solution having a heterocyclic compound concentration of 0.00100 M, a potassium bicarbonate concentration of 0.0200 M and a potassium carbonate concentration of 0.0267 M is prepared, and the pH of the solution is adjusted to 10.0 using 1 M of nitric acid or sodium hydrate. Then, 1 mL of 0.00500 M silver nitrate is added to the solution at a temperature of 20° C. to 25° C. while magnetically stirring. Subsequently, a potential after 15 minutes of the addition of the silver nitrate is measured by an electrochemical method using a calomel electrode. A value of potential represented by a unit of mV, which is determined at this point in time, is an interaction potential.

The interaction potential is a scale of an interaction between the metal nanowire and the heterocyclic compound, i.e. a scale indicating the adsorption force of the heterocyclic compound onto the metal nanowire particles. When the interaction potential is small, it indicates that the adsorption force of the heterocyclic compound onto the metal nanowire particles is strong. In contrast, when the interaction potential is large, it indicates that the adsorption force of the heterocyclic compound onto the metal nanowire particles is weak.

Note that an interaction potential measured using silver ions is used to represent the interaction potential, however, other metal ions tend to have a similar result to that of silver ions.

Here, the "heterocyclic compound" is a compound having a heterocycle containing at least one hetero atom. The "hetero atom" means an atom other than a carbon atom and a hydrogen atom. The heterocycle means a ring compound having at least one hetero atom. The heterocyclic compound may have any number of hetero atoms. It should be noted that the hetero atom means only an atom that constitutes a constituent portion of a ring system of the heterocycle but not an atom located outside of the ring system, nor an atom separated from the ring system via at least one non-conjugate single bond, and nor an atom that is a part of a further substituent of the ring system.

Preferred examples of the hetero atoms include a nitrogen atom, a sulfur atom, an oxygen atom, a selenium atom, a tellurium atom, a phosphorus atom, a silicon atom and a boron atom. More preferred examples thereof include a nitrogen atom, a sulfur atom, an oxygen atom and a selenium atom. Particularly preferred examples thereof include a nitrogen atom, a sulfur atom and an oxygen atom. Most preferred examples thereof include a nitrogen atom and a sulfur atom.

The heterocyclic compound which may be employed by the present invention is not particularly limited in the number of members of its heterocyclic rings, however, the heterocyclic compound preferably has three to eight heterocyclic ring members, more preferably five to seven heterocyclic ring members, and still more preferably five or six heterocyclic ring members.

The heterocyclic ring may be saturated or unsaturated, but the heterocyclic ring preferably has at least one unsaturated site, and more preferably has at least two unsaturated sites. In other words, the heterocyclic ring may be any one of an aromatic heterocyclic ring, a pseudoaromatic heterocyclic ring and a non-aromatic heterocyclic ring, but preferred are an aromatic heterocyclic ring and a pseudoaromatic heterocyclic ring, and more preferred is an aromatic heterocyclic ring.

Specific examples of the heterocyclic rings include a pyrrole ring, a thiophene ring, a furan ring, an imidazole ring, a pyrazole ring, thiazole ring, an isothiazole ring, an oxazole ring, an isooxazole ring, 1,2,4-triazole ring, 1,2,3-triazole ring, a tetrazole ring, 1,2,5-thiazole ring, 1,3,4-thiazole ring, 1,2,3,4-thiatriazole ring, a pyridine ring, a pyrazine ring, a pyrimidine ring, a pyridazine ring, and indolizine ring.

Further, the following benzo-condensed rings of the above rings are also exemplified: an indole ring, a benzofuran ring, a benzothiophene ring, an isobenzofuran ring, a benzimidazole ring, a benzotriazole ring, a benzothiadiazole ring, a benzooxadiazole ring, a quinolidine ring, a quinoline ring, a phtharazine ring, a quinoxaline ring, an isoquinoline ring, a carbazole ring, a phenanthridine ring, a phenanthroline ring, an acridine ring, a purine ring, 4,4'-bipyridine ring, 1,2-bis(4-pyridyl)ethane ring, and 4,4'-trimethylenedipyridine ring.

Further, a pyrrolidine ring, a pyrroline ring and an imidazoline ring, etc. each formed by partial saturation or total saturation of the rings described above are also exemplified.

The following are examples of typical heterocyclic rings.

(aa-1)

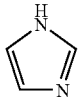

(aa-2)

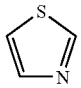

(aa-3)

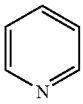

-continued (aa-4)

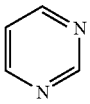

(aa-5)

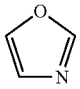

(aa-6)

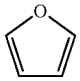

(aa-7)

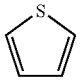

(aa-8)

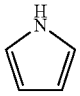

(aa-9)

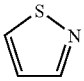

(aa-10)

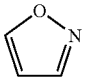

(aa-11)

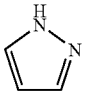

(aa-12)

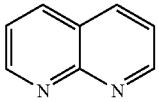

(aa-13)

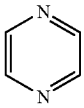

(aa-14)

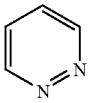

(aa-15)

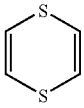

(aa-16)

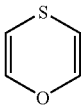

(aa-17)

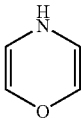

-continued
(aa-18)
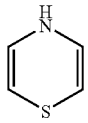
(aa-19)
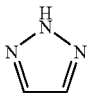
(aa-20)
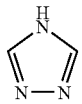
(aa-21)
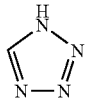
(aa-22)
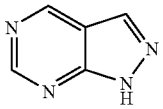
(aa-23)
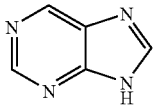
(aa-24)
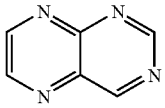
The following are examples of heterocyclic rings formed by condensation of benzene ring.
(ab-1)
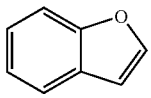
(ab-2)
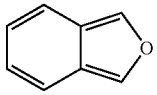
(ab-3)
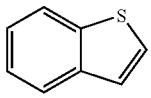
(ab-4)
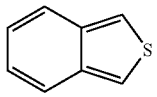
(ab-5)
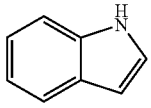
(ab-6)
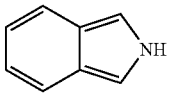
-continued
(ab-7)
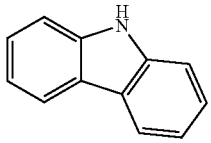
(ab-8)
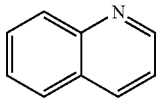
(ab-9)
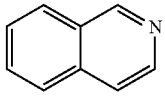
(ab-10)
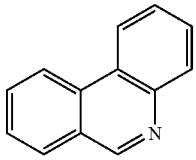
(ab-11)
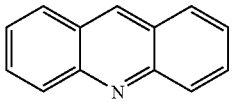
(ab-12)
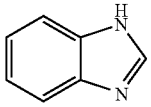
(ab-13)
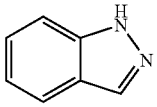
(ab-14)
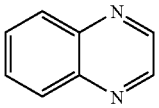
(ab-15)
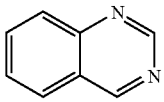
(ab-16)
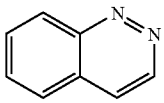
(ab-17)
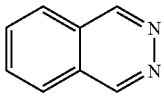
(ab-18)
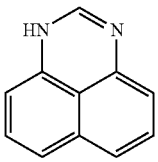

-continued
(ab-19)
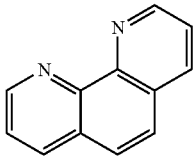
(ab-20)
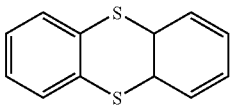
(ab-21)
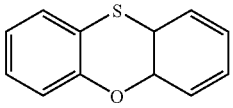
(ab-22)
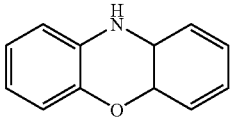
(ab-23)
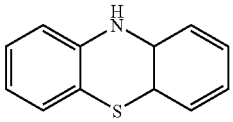
(ab-24)
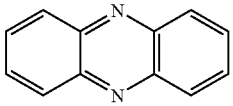
(ab-25)
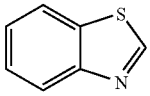
(ab-26)
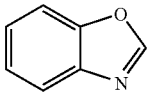
(ab-27)
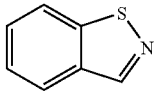
(ab-28)
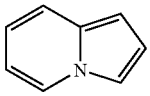
(ab-29)
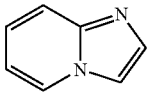
(ab-30)
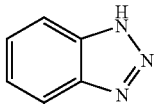
(ab-31)
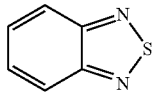
The following are examples of partially or fully saturated heterocyclic rings.
(ac-1)
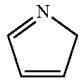
(ac-2)
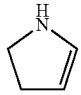
(ac-3)
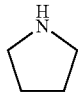
(ac-4)
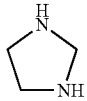
(ac-5)
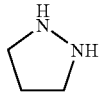
(ac-6)
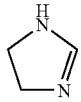
(ac-7)
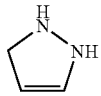
(ac-8)
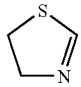
(ac-9)
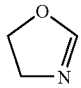
(ac-10)
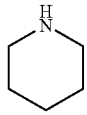
(ac-11)
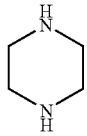
(ac-12)
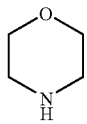
(ac-13)
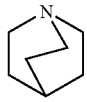

-continued (ac-14)

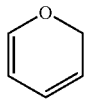

(ac-15)

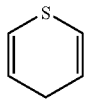

(ac-16)

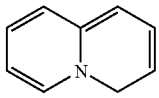

(ac-17)

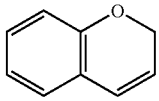

(ac-18)

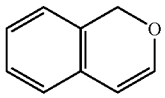

(ac-19)

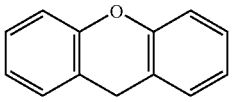

Besides the above, the following heterocyclic rings may be used.

(ad-1)

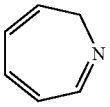

(ad-2)

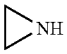

(ad-3)

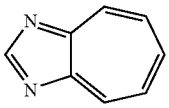

(ad-4)

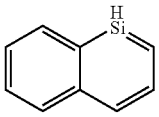

(ad-5)

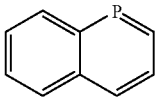

(ad-6)

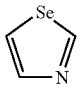

(ad-7)

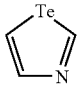

-continued (ad-8)

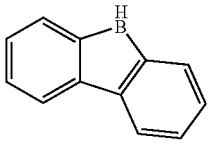

The ring structures may be substituted or condensed with any kind of substituent, and as the substituent, the after-mentioned Ws are exemplified. Also, at least one tertiary nitrogen atom contained in these heterocyclic rings is optionally substituted to become a quaternary nitrogen atom or quaternary nitrogen atoms. Note that in any case where a tautomeric structure different from a heterocyclic ring can be formed, it may appear to be equivalent thereto.

Among these heterocyclic rings, (aa-1), (aa-3), (aa-19), (aa-20), (ab-12) and (ab-25) are particularly preferable.

When in the heterocyclic compound, a specific portions is called "group" and even when this portion itself is not substituted, it means that this portion is optionally substituted with one or more substituents, i.e., up to the maximum allowable number of substituents. For instance, the term "alkyl group" means a substituted or unsubstituted alkyl group. Also, any types of substituents can be used for the heterocyclic compound, irrespective of the presence or absence of substitution.

When such a substituent is regarded as "W", the substituent represented by W are not particularly limited and may be suitably selected in accordance with the intended use. Specific examples thereof include a halogen atom, an alkyl group (including cycloalkyl group, bicycloalkyl group, and tricycloalkyl group), an alkenyl group (including cycloalkenyl group, and bicycloalkenyl group), an alkynyl group, an aryl group, a heterocyclic ring group (may be referred to as heterocyclic group), a cyano group, a hydroxyl group, a nitro group, a carboxyl group, an alkoxy group, an aryloxy group, a silyloxy group, a heterocyclic oxy group, an acyloxy group, a carbamoyl oxy group, an alkoxy carbonyloxy group, an aryloxy carbonyloxy group, an amino group (including alkylamino group, arylamino group, heterocyclic amino group), an ammonio group, acylamino group, an aminocarbonyl amino group, an alkoxycarbonyl amino group, aryloxycarbonyl amino group, a sulfamoyl amino group, an alkyl- and aryl-sulfonyl amino group, a mercapto group, an alkylthio group, a heterocyclic thio group, a sulfamoyl group, a sulfo group, an alkyl- and aryl-sulfinyl group, an alkyl- and aryl-sulfonyl group, an acyl group, an aryloxy carbonyl group, an alkoxycarbonyl group, a carbamoyl group, an aryl- and heterocyclic azo group, an imide group, a phosphino group, a phosphinyl group, a phosphinyl oxy group, a phosphinyl amino group, a phosphono group, a silyl group, a hydradino group, a ureide group, a boronic acid group (—$B(OH)_2$), a phosphato group (—$OPO(OH)_2$), a sulphato group (—$OSO_3H$), and other conventionally know substituents.

More specifically, W represents a halogen atom (e.g. a fluorine atom, a chlorine atom, a boron atom, an iodine atom or the like) an alkyl group [a straight-chain, branched or cyclic substituted or unsubstituted alkyl group]. Each of these may be an alkyl group (preferably, an alkyl group having 1 to 30 carbon atom(s), for example, methyl group, ethyl group, n-propyl group, isopropyl group, t-butyl group, n-octyl group, eicosyl group, 2-chloroethyl group, 2-cyanoethyl group, 2-ethylhexyl group), a cycloalkyl group (preferably, a substituted or unsubstituted cycloalkyl group having 3 to 30 carbon atoms, for example, cyclohexyl group, cyclopentyl group, 4-n-dodecylcyclohexyl group), a bicycloalkyl group (preferably, a substituted or unsubstituted bicycloalkyl group having 5 to 30 carbon atoms, that is to say, a univalent group obtained by eliminating one hydrogen atom from a bicycloalkane having 5 to 30 carbon atoms, for example, bicyclo[1,2,2]heptane-2-yl or bicyclo[2,2,2]octane-3-yl) and further a tricyclo group having a polycyclic structure, an alkyl group contained in a substituent group described below (for example, an alkyl group contained in an alkylthio group) also representing an alkyl group having such a concept], an alkenyl group [which represents a straight-chain, branched or cyclic substituted or unsubstituted alkenyl group, including an alkenyl group (preferably, a substituted or unsubstituted alkenyl group having 2 to 30 carbon atoms, for example, vinyl, allyl, prenyl, geranyl or oleyl), a cycloalkenyl group (preferably, a substituted or unsubstituted cycloalkenyl group having 3 to 30 carbon atoms, that is to say, a univalent group obtained by eliminating one hydrogen atom from a cycloalkene having 3 to 30 carbon atoms, for example, 2-cyclopentene-1-yl or 2-cyclohexene-1-yl) and a bicycloalkenyl group (a substituted or unsubstituted bicycloalkenyl group, preferably, a substituted or unsubstituted bicycloalkenyl group having 5 to 30 carbon atoms, that is to say, a univalent group obtained by eliminating one hydrogen atom from a bicycloalkene having one double bond, for example, bicyclo[2,2,1]hepto-2-ene-1-yl or bicyclo[2,2,2]octo-2-ene-4-yl)], an alkynyl group (preferably, a substituted or unsubstituted alkynyl group having 2 to 30 carbon atoms, for example, ethynyl, propargyl or trimethylsilylethynyl), an aryl group (preferably, a substituted or unsubstituted aryl group having 6 to 30 carbon atoms, for example, phenyl, p-tolyl, naphthyl, m-chlorophenyl or o-hexadecanoylaminophenyl), a heterocyclic group (preferably, a univalent group obtained by eliminating one hydrogen atom from a 5- or 6-membered, substituted or unsubstituted, aromatic or nonaromatic heterocyclic compound, which may be condensed with a benzene ring, or the like, and more preferably, a 5- or 6-membered aromatic heterocyclic group having 3 to 30 carbon atoms, for example, 2-furyl, 2-thienyl, 2-pyrimidinyl or 2-benzothiazolyl; note that a cationic heterocyclic group such as 1-methyl-2-pyridinio, 1-methyl-2-quinolino), a cyano group, a hydroxyl group, a nitro group, an alkoxyl group (preferably, a substituted or unsubstituted alkoxyl group having 1 to 30 carbon atoms, for example, methoxy, ethoxy, isopropoxy, t-butoxy, n-octyloxy or 2-methoxyethoxy), an aryloxy group (preferably, a substituted or unsubstituted aryloxy group having 6 to 30 carbon atoms, for example, phenoxy, 2-methylphenoxy, 4-t-butylphenoxy, 3-nitrophenoxy or 2-tetradecanoylaminophenoxy), a silyloxy group (preferably, a silyloxy group having 3 to 20 carbon atoms, for example, trimethylsilyloxy or t-butyldimethylsilyloxy), a heterocyclic oxy group (preferably, a substituted or unsubstituted heterocyclic oxy group having 2 to 30 carbon atoms, for example, 1-phenyltetrazole-5-oxy or 2-tetrahydropyranyloxy), an acyloxy group (preferably, a formyloxy group, a substituted or unsubstituted alkylcarbonyloxy group having 2 to 30 carbon atoms or a substituted or unsubstituted arylcarbonyloxy group having 7 to 30 carbon atoms, for example, formyloxy, acetyloxy, pivaloyloxy, stearoyloxy, benzoyloxy or p-methoxyphenylcarbonyloxy), a carbamoyloxy group (preferably, a substituted or unsubstituted carbamoyloxy group having 1 to 30 carbon atoms, for example, N,N-dimethylcarbamoyloxy, N,N-diethylcarbamoyloxy, morpholinocarbonyloxy, N,N-di-n-octylaminocarbonyloxy or N-n-octylcarbamoyloxy), an alkoxycarbonyloxy group (preferably, a substituted or unsubstituted alkoxycarbonyloxy group having 2 to 30 carbon atoms, for example, methoxycarbonyloxy, ethoxycarbonyloxy, t-butoxycarbonyloxy or n-octylcarbonyloxy), an aryloxycarbonyloxy group (preferably, a substituted or unsubstituted aryloxycarbonyloxy group having 7 to 30 carbon atoms, for example, phenoxycarbonyloxy, p-methoxyphenoxycarbonyloxy or p-n-hexadecyloxyphenoxycarbonyloxy), an amino group (preferably, an amino group, a substituted or unsubstituted alkylamino group having 1 to 30 carbon atoms, a substituted or unsubstituted arylamino group having 6 to 30 carbon atoms, or a heterocyclic amino group, for example, amino, methylamino, anilino, N-methyl-anilino or diphenylamino, 2-pyridylamino), an ammonio group (preferably, an ammonio group, an ammonio group substituted with a substituted or unsubstituted alkyl group having 1 to 30 carbon atoms, aryl or heterocyclic group, for example, trimethylammonio, triethylammonio, diphenylmethylammonio), an acylamino group (preferably, a formylamino group, a substituted or unsubstituted alkylcarbonylamino group having 1 to 30 carbon atoms or a substituted or unsubstituted arylcarbonylamino group having 6 to 30 carbon atoms, for example, formylamino, acetylamino, pivaloylamino, lauroylamino, benzoylamino or 3,4,5-tri-n-octyloxyphenylcarbonylamino), an aminocarbonylamino group (preferably, a substituted or unsubstituted aminocarbonylamino group having 1 to 30 carbon atoms, for example, carbamoylamino, N,N-dimethylaminocarbonylamino, N,N-diethylaminocarbonylamino or morpholinocarbonylamino), an alkoxycarbonylamino group (preferably, a substituted or unsubstituted alkoxyl-carbonylamino group having 2 to 30 carbon atoms, for example, methoxycarbonylamino, ethoxycarbonylamino, t-butoxycarbonylamino, n-octadecyloxycarbonylamino or N-methylmethoxycarbonylamino), an aryloxycarbonylamino group (preferably, a substituted or unsubstituted aryloxycarbonylamino group having 7 to 30 carbon atoms, for example, phenoxycarbonylamino, p-chlorophenoxycarbonylamino or m-n-octyloxyphenoxycarbonylamino), a sulfamoylamino group (preferably, a substituted or unsubstituted sulfamoylamino group having 0 to 30 carbon atoms, for example, sulfamoylamino, N,N-dimethylaminosulfonylamino or N-n-octylaminosulfonylamino), an alkylsulfonylamino group or an arylsulfonylamino group (preferably, a substituted or unsubstituted alkylsulfonylamino group having 1 to 30 carbon atoms or a substituted or unsubstituted aryl sulfonyl amino group having 6 to 30 carbon atoms, for example, methylsulfonylamino, butylsulfonylamino, phenylsulfonylamino, 2,3,5-trichlorophenylsulfonylamino or p-methylphenylsulfonylamino), a mercapto group, an alkylthio group (preferably, a substituted or unsubstituted alkylthio group having 1 to 30 carbon atoms, for example, methylthio, ethylthio or n-hexadecylthio), an arylthio group (preferably, a substituted or unsubstituted arylthio group having 6 to 30 carbon atoms, for example, phenylthio, p-chlorophenylthio or m-methoxyphenylthio), a heterocyclic thio group (preferably, a substituted or unsubstituted heterocyclic thio group having 2 to 30 carbon atoms, for example, 2-benzothiazolylthio or 1-phenyltetrazole-5-ylthio), a sulfamoyl group (preferably, a substituted or unsubstituted sulfamoyl group having 0 to 30 carbon atoms, for example, N-ethylsulfamoyl, N-(3-dodecyloxypropyl)sulfamoyl, N,N-dimethylsulfamoyl, N-acetylsulfamoyl, N-benzoylsulfamoyl or N—(N'-phenylcarbamoyl)sulfamoyl), a sulfo group, an alkylsulfinyl group or an arylsulfinyl group (preferably, a substituted or unsubstituted alkylsulfinyl group having 1 to 30 carbon atoms or a substituted or unsubstituted arylsulfinyl group having 6 to 30 carbon atoms, for example, methylsulfinyl, ethylsulfinyl, phenylsulfinyl or p-methylphenylsulfinyl), an alkylsulfonyl group or an arylsulfonyl group (preferably, a substituted or unsubstituted alkylsulfonyl group having 1 to 30 carbon atoms or a substituted or unsubstituted arylsulfonyl group having 6 to 30 carbon atoms, for example, methylsulfonyl, ethylsulfonyl, phenylsulfonyl or p-methylphenylsulfonyl), an acyl group (preferably, a formyl group, a substituted or unsubstituted alkylcarbonyl group having 2 to 30 carbon atoms, a substituted or unsubstituted arylcarbonyl group having 7 to 30 carbon atoms or a substituted or unsubstituted heterocyclic carbonyl group having 4 to 30 carbon atoms in which a heterocycle is linked by a carbon atom to a carbonyl group, for example, acetyl, pivaloyl, 2-chloroacetyl, stearoyl, benzoyl, p-n-octyloxyphenylcarbonyl, 2-pyridylcarbonyl or 2-furylcarbonyl), an aryloxycarbonyl group (preferably, a substituted or unsubstituted aryloxycarbonyl group having 7 to 30 carbon atoms, for example, phenoxycarbonyl, o-chlorophenoxycarbonyl, m-nitrophenoxycarbonyl or p-t-butylphenoxycarbonyl), an alkoxycarbonyl group (preferably, a substituted or unsubstituted alkoxycarbonyl group having 2 to 30 carbon atoms, for example, methoxycarbonyl, ethoxycarbonyl, t-butoxycarbonyl or n-octadecyloxycarbonyl), a carbamoyl group (preferably, a substituted or unsubstituted carbamoyl group having 1 to 30 carbon atoms, for example, carbamoyl, N-methylcarbamoyl, N,N-dimethylcarbamoyl, N,N-di-n-octylcarbamoyl or N-(methylsulfonyl)carbamoyl), an arylazo group or a heterocyclic azo group (preferably, a substituted or unsubstituted arylazo group having 6 to 30 carbon atoms or a substituted or unsubstituted heterocyclic azo group having 3 to 30 carbon atoms, for example, phenylazo, p-chlorophenylazo or 5-ethylthio-1,3,4-thiadiazole-2-ylazo), an imido group (preferably, N-succinimido or N-phthalimido), a phosphino group (preferably, a substituted or unsubstituted phosphino group having 2 to 30 carbon atoms, for example, dimethylphosphino, diphenylphosphino or methylphenoxyphosphino), a phosphinyl group (preferably, a substituted or unsubstituted phosphinyl group having 2 to 30 carbon atoms, for example, phosphinyl, dioctyloxyphosphinyl or diethoxyphosphinyl), a phosphinyloxy group (preferably, a substituted or unsubstituted phosphinyloxy group having 2 to 30 carbon atoms, for example, diphenoxyphosphinyloxy or dioctyloxyphosphinyloxy), a phosphinylamino group (preferably, a substituted or unsubstituted phosphinylamino group having 2 to 30 carbon atoms, for example, dimethoxyphosphinylamino or dimethylaminophosphinylamino), a silyl group (preferably, a substituted or unsubstituted silyl group having 3 to 30 carbon atoms, for example, trimethylsilyl, t-butyldimethylsilyl or phenyldimethylsilyl), a hydradino group (preferably, a substituted or unsubstituted hydrazino group having 0 to 30 carbon atoms, for example, trimethylhydrazino), or a ureide group (preferably, a substituted or unsubstituted ureide group having 0 to 30 carbon atoms, for example, N,N-dimethylureide).

Also, two Ws may together form a ring (an aromatic or nonaromatic hydrocarbon ring, a heterocyclic ring, or these may further be combined to form a polycyclic condensed ring; for example, benzene ring, naphthalene ring, anthracene ring, phenanthrene ring, fluorene ring, triphenylene ring, naphthasene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolidine ring, quinoline ring, phtharazine ring, naphthylidine ring, quinoxaline ring, isoquinoline ring, carbazole ring, phenanthridine ring, acridine ring, phenanthroline ring, thianthrene ring, chromene ring, xanthene ring, phenoxazine ring, phenothiazine ring, phenazine ring).

In the substituents Ws described above, those having a hydrogen atom at its hydrogen atom with any of the above-mentioned substituents. Examples of such a substituent are as follows:

—$CONHSO_2$— group (e.g. sulfonylcarbamoyl group, carbonylsulfamoyl group), —CONHCO— group (e.g. carbonylcabamoyl group), —$SO_2NHSO_2$— group (e.g. sulfonylsulfamoyl group).

More specifically, they include an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl), an arylsulfonylaminocarbonyl group (e.g., p-methylphenylaulfonylaminocarbonyl).

Among the heterocyclic compounds described above in detail, the following are particularly preferable examples, which however, should not be construed as limiting the present invention in any way. Note that EAg represents an interaction potential of silver.

(at-1)

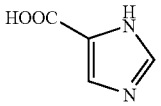

EAg: -44 mV (at-2)

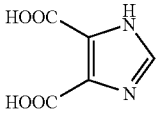

EAg: -49 mV (at-3)

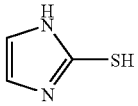

EAg: -297 mV (at-4)

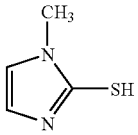

EAg: -313 mV (at-5)

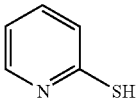

EAg: -227 mV (at-6)

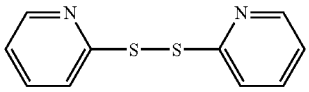

EAg: -193 mV (at-7)

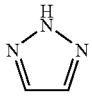

EAg: -50 mV

-continued (at-8)

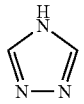

EAg: -48 mV (at-9)

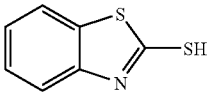

EAg: -376 mV (at-10)

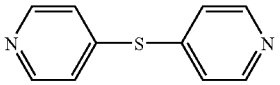

EAg: -55 mV (at-11)

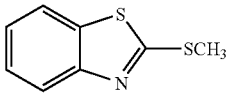

EAg: -96 mV (at-12)

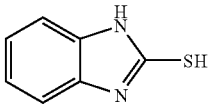

EAg: -152 mV (at-13)

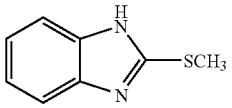

EAg: -76 mV (at-14)

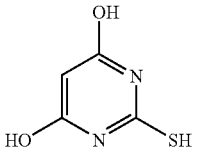

EAg: -201 mV (at-15)

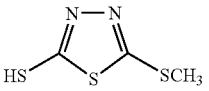

EAg: -408 mV (at-16)

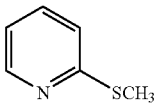

EAg: -11 mV (at-17)

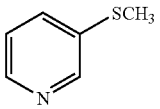

EAg: -29 mV

-continued (at-18)

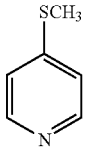

EAg: -62 mV (at-19)

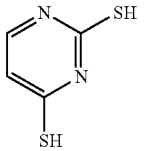

EAg: -520 mV (at-20)

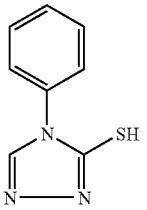

EAg: -230 mV (at-21)

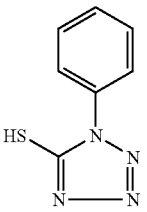

EAg: -240 mV

As a method of incorporating a heterocyclic compound solution in a metal wire-containing composition, the following methods are preferable, however, the method is not limited thereto.

1 Addition of a heterocyclic compound solution into a metal nanowire-containing composition Before coating of a metal nanowire-containing composition, a heterocyclic compound solution may be added into the metal nanowire-containing composition. On that occasion, the mixing time after the addition of the heterocyclic compound solution is preferably one minute to 60 minutes, and more preferably two minutes to 30 minutes. The temperature of the dispersion during the mixing is preferably 20° C. to 80° C., and more preferably 30° C. to 60° C.

2 Simultaneous addition of a heterocyclic compound solution at the timing of coating a metal nanowire-containing composition; Simultaneous addition of a heterocyclic compound solution into a separate layer at the timing of coating a metal nanowire-containing composition; or Coating a heterocyclic compound solution after the coating of the dispersion At the timing of coating a metal nanowire-containing composition, coating of a liquid in which a heterocyclic compound has been dissolved in a solvent such as water or methanol may be performed simultaneously. On that occasion, immediately before the coating, the metal nanowire-containing composition and the heterocyclic compound solution may be mixed with each other, or may be individually coated in a separate layer. Also, after coating of a metal nanowire-containing composition, a compound (A) solution may be coated thereover.

3 Immersion of a dispersion liquid coating sample into a heterocyclic compound solution Further, after coating of a metal nanowire-containing composition, a coating sample of the metal nanowire-containing composition may be immersed in a heterocyclic compound solution so as to incorporate the solution into the sample. In this case, the immersion time is preferably one minute to 60 minutes, and more preferably two minutes to 30 minutes. The temperature of the solution in the immersion process is preferably 10° C. to 60° C., and more preferably 20° C. to 50° C. The concentration of the heterocyclic compound at this point in time is preferably 0.1% to 10%, and more preferably 0.5% to 5%.

The amount of the heterocyclic compound added in the metal nanowire-containing composition is preferably $1\times10^{5}$ moles to 1 mole, more preferably $5\times10^{5}$ moles to $1\times10^{1}$ moles, and particularly preferably $1\times10^{4}$ moles to $5\times10^{2}$ moles per one mole of metal in the metal nanowire-containing composition.

The metal nanowire-containing composition of the present invention further contains an aqueous solvent to be used as an aqueous dispersion.

As the aqueous solvent, water is mainly used, and an organic solvent miscible with water can be used in an amount of 80% by volume or less, in combination with water.

As the organic solvent, it is preferable to use an alcohol compound preferably having a boiling point of 50° C. to 250° C., more preferably having a boiling point of 55° C. to 200° C. Use of such an alcohol compound in combination makes it possible to improve coating performance in the coating process and to reduce the dry load.

The alcohol compound is not particularly limited and may be suitably selected in accordance with the intended use. Specific examples thereof include methanol, ethanol, ethylene glycol, diethylene glycol, triethylene glycol, polyethylene glycol 200, polyethylene glycol 300, glycerin, propylene glycol, dipropylene glycol, 1,3-propane diol, 1,2-butane diol, 1,4-butane diol, 1,5-pentane diol, 1-ethoxy-2-propanol, ethanolamine, diethanolamine, 2-(2-aminoethoxy) ethanol, and 2-dimethylamino isopropanol. Among these, preferred are ethanol, and ethylene glycol. These may be used alone or in combination.

The metal nanowire-containing composition of the present invention does preferably not contain inorganic ions such as alkali metal ions, alkali earth metal ions, and halide ions.

The electric conductivity of the aqueous dispersion is preferably 1 mS/cm or less, more preferably 0.1 mS/cm or less, and still more preferably 0.05 mS/cm or less.

The viscosity of the aqueous dispersion at 20° C. is preferably 0.5 mPa·s to 100 mPa·s, and more preferably 1 mPa·s to 50 mPa·s.

The metal nanowire-containing composition can contain various additives as necessary, for example, a surfactant, a polymerizable compound, an antioxidant, an anti-sulphidizing agent, a corrosion inhibitor, a viscosity modifier, and an antiseptic agent.

The corrosion inhibitor is not particularly limited and may be suitably selected in accordance with the intended use, however, azoles are preferably used. For example, the corrosion inhibitor is exemplified by at least one selected from the azoles include benzotriazole, tolyltriazole, mercaptobenzothiazole, mercaptobenzotetrazole, (2-benzothiazoryl)thio acetic acid, 3-(2-benzothiazoryl)thio propionic acid, and alkali salts, ammonium salts and amine salts thereof. By incorporation of the corrosion inhibitor into the metal nanowire-containing composition, the resulting metal nanowire can exhibit extremely excellent corrosion preventive effect. The corrosion inhibitor can be directly added in a state of being dissolved in a suitable solvent or in the form of powder, into the aqueous dispersion, or can be immersed in a corrosion inhibitor bath after the after-mentioned transparent conductor has been prepared.

The metal nanowire-containing composition can be also preferably used in aqueous inks for inkjet printer and aqueous inks for dispenser.

In use of the metal nanowire-containing composition in image formation by an inkjet printer, as a substrate to be coated with the aqueous dispersion, there may be exemplified paper, coat paper, and a PET film whose surface has been coated with a hydrophilic polymer.

(Transparent Conductor)

A transparent conductor according to the present invention includes a transparent conductive layer formed of the metal nanowire-containing composition of the present invention.

The method for production a transparent conductor includes applying the metal nanowire-containing composition onto a substrate and drying the applied composition.

Hereinafter, details of the transparent conductor of the present invention will be described through the description on the method for producing a transparent conductor.

A substrate onto which the metal nanowire-containing composition is applied is not particularly limited and may be suitably selected in accordance with the intended use. For example, as a substrate for transparent conductor, the following materials are exemplified. Among these materials, a polymer film is preferable, and a PET film, a TAC film and a PEN film are particularly preferable in terms of the production applicability, lightweight property, pliability, optical properties (polarizing properties), etc.

1 glass such as quartz glass, non-alkali glass, crystallized transparent glass, Pyrex™, and sapphire glass 2 acrylic resins such as polycarbonate, and polymethyl methacrylate; vinyl chloride resins such as polyvinyl chloride, and vinyl chloride copolymers; and thermoplastic resins such as polyallylate, polysulfone, polyether sulfone, polyimide, PET, PEN, fluorine resin, phenoxy resin, polyolefin resin, nylon, styrene resin, and ABS resins.

3 thermosetting resins such as epoxy resin

The substrate materials are optionally used in combination. Two or more materials are suitably selected from these substrate materials to produce a pliable substrate in the form of a film or the like, or a rigid substrate.

The substrate may take any shapes such as, in the form of a disc, a card, a sheet, or the like. The substrate may be three-dimensionally laminated. Further, the substrate optionally has micro-pores or a thin groove having an aspect ratio of 1 or more at portions on its surface to be provided with printed wiring. It is also possible to eject the aqueous dispersion of the present invention in the micro-pores or thin groove by an inkjet printer or dispenser.

The surface of the substrate is preferably subjected to a hydrophilicity treatment. Also, preferred is a substrate whose surface is coated with a hydrophilic polymer. With this, the coating property and adhesiveness of the metal nanowire-containing composition to a substrate are improved.

The hydrophilicity treatment is not particularly limited and may be suitably selected in accordance with the intended use. Examples there of include chemical treatment, mechanically coarse-surface providing treatment, corona discharging treatment, flame treatment, ultraviolet ray treatment, glow discharging treatment, plasma activation treatment, and laser treatment. It is preferred to control the surface tension of the substrate surface to 30 dyne/cm or more.

The hydrophilic polymer to be applied to the substrate surface is not particularly limited and may be suitably selected in accordance with the intended use. Examples thereof include gelatin, gelatin derivatives, casein, agar, starch, polyvinyl alcohol, polyacrylic acid copolymers, carboxy-methyl cellulose, hydroxyethyl cellulose, polyvinyl pyrrolidone, and dextran.

The dried layer thickness of the hydrophilic polymer layer is preferably 0.001μ to 100μ, and more preferably 0.01μ to 20μ.

It is preferred to add a hardener into the hydrophilic polymer layer to increase the film strength. The hardener is not particularly limited and may be suitably selected in accordance with the intended use. Examples of the hardener include aldehyde compounds such as formaldehyde, and glutaraldehyde; ketone compounds such as diacetyl, and cyclopentane dione; vinyl sulfone compounds such as divinyl sulfone; triazine compounds such as 2-hydroxy-4,6-dichloro-1,3,5-triazine; and isocyanate compounds as described in U.S. Pat. No. 3,103,437.

The hydrophilic polymer layer can be formed in the following manner. Firstly, the above-noted compound is dissolved or dispersed in a solvent such as water to prepare a coating liquid, the coating liquid is applied on a substrate surface that has been subjected to a hydrophilicity treatment by a coating method such as spin coating, dip coating, extrusion coating, bar coating, and dye coating, and the applied coating liquid is dried, thereby forming a hydrophilic polymer layer. The drying temperature is preferably 120° C. or lower, more preferably 30° C. to 100° C., and still more preferably 40° C. to 80° C.

Further, an under-coat layer is optionally formed between the substrate and the hydrophilic polymer layer as necessary with a view toward improving the adhesiveness.

In the present invention, after the transparent conductor has been prepared, the transparent conductor can be bathed in a corrosion inhibitor bath. With this, it is possible to obtain a further excellent corrosion prevention effect.

—Application—

The transparent conductor of the present invention can be widely used, for example, in touch panels, antistatic displays, electromagnetic shields, electrodes for organic or inorganic ET, display, electron paper, electrodes for flexible-display, antistatic panels for flexible display, solar cell panels, and various other devices.

EXAMPLES

Hereinafter, the present invention will be described in detail referring to specific Examples, however, the present invention is not limited to the disclosed Examples.

In the following Examples, an interaction potential of silver EAg, a diameter and a major axis length of metal nanowires, a variation coefficient of diameter of metal nanowires, an appropriate wiring rate, and a degree of sharpness of cross-section angles of metal nanowires were measured in the following manners.

<Measurement of Interaction Potential of Silver EAg>

In order to determine an interaction potential of silver EAg, 50 mL of a solution having a heterocyclic compound concentration of 0.00100 M, a potassium bicarbonate concentration of 0.0200 M and a potassium carbonate concentration of 0.0267 M was prepared, and the pH of the solution was adjusted to 10.0 using 1 M of nitric acid or sodium hydrate. Then, 1 mL of 0.00500 M silver nitrate was added to the solution at a temperature of 20° C. to 25° C. while magnetically stirring. Subsequently, a potential 15 minutes after the addition of the silver nitrate was measured by an electrochemical method using a calomel electrode. A value of potential represented by a unit of mV, which was determined at this point in time, is an interaction potential of silver EAg.

<Measurement of Diameter and Major Axis Length of Metal Nanowire>

Using a transmission electron microscope (TEM) (JEM-2000FX, manufactured by JEOL Ltd.), 300 particles of metal nanowire were observed to determine each average value of diameters and major axis lengths, and from these average values, the diameter and the major axis length of the metal nanowire were determined.

<Measurement of Coefficient of Variation in Diameter of Metal Nanowire>

Using a transmission electron microscope (TEM) (JEM-2000FX, manufactured by JEOL Ltd.), 300 particles of metal nanowire were observed to determine a standard deviation and an average diameter were calculated, thereby determining the coefficient of variation in diameter of the metal nanowire.

<Appropriate Wiring Rate>

Each aqueous dispersion liquid of silver nanowire was filtered to separate silver nanowire particles from particles other then the silver nanowire particles, and the amount of Ag remaining on the paper filter and the amount of Ag had passed through the paper filter were respectively measured by means of ICP (inductively coupled plasma) spectrometer (ICPS-8000, manufactured by Shimadzu Corporation), and the amount of metal (% by mass) of metal nanowire particles having a diameter of 50 nm or smaller and a length of 5 μm or longer (appropriate wires) in the total metal particles was determined.

The separation of appropriate wires at the time of determining an appropriate wiring rate was carried out using a membrane filter (manufactured by Millipore, FALP 02500, pore size: 1.0 μm).

<Measurement of Degree of Sharpness of Cross-Section Angles>

With respect to the cross-sectional shape of metal nanowire, an aqueous dispersion of metal nanowire was applied onto a substrate, and cross-sections of the substrate were observed by a transmission electron microscope (TEM) (JEM-2000FX, manufactured by JEOL Ltd.). With respect to cross-sections of 300 particles of metal nanowire in total, a circumferential length of each cross-section and a total length of respective sides of the cross-section were measured, to thereby determine a ratio of the circumferential length of the cross-section to the total length of respective sides of the cross-section, i.e., a degree of sharpness. When the degree of sharpness was 75% or less, it was determined as a metal nanowire having a cross-sectional shape having rounded angles.

Preparation Example 1

Preparation of Additive Liquid A

In 50 mL of pure water, 0.51 g of silver nitrate powder was dissolved to obtain a solution. Subsequently, 1N ammonia water was added to the solution until it became transparent. Then, pure water was further added to the solution so that the total amount was 100 mL.

Preparation Example 2

Preparation of Additive Liquid G

In 140 mL of pure water, 0.5 g of glucose powder was dissolved to prepare an additive liquid G.

Preparation Example 3

Preparation of Additive Liquid H

In 27.5 mL of pure water, 0.5 g of HTAB (hexadecyltrimethyl ammonium bromide) powder was dissolved to prepare an additive liquid H.

Production Example 1

Production of Silver Nanowire Aqueous Dispersion Sample 101

In a three-necked flask, 410 mL of pure water, 82.5 mL of the additive liquid H and 206 mL of the additive liquid G were poured through a funnel while stirring at 20° C. (first step). Into this liquid, 206 mL of the additive liquid A was added at a flow rate of 2.0 mL/min and at the number of stirring revolutions per minute of 800 rpm (second step). Ten minutes later, 82.5 mL of the additive liquid H was added to the liquid. Then, temperature of the inside system was raised to 75° C. at a temperature increase rate of 3° C./min. Then, the number of stirring revolutions per minute was decreased to 200 rpm, and the liquid was heated for 5 hours.

The resulting aqueous dispersion liquid was cooled. Meanwhile, an ultrafiltration module SIP1013 (molecular cutoff 6,000; produced by ASAHI KASEI CORPORATION), a magnet pump and a stainless steel cup were connected to each other with a silicon tube to prepare an ultraviltrater. The silver nanowire dispersion liquid (aqueous dispersion liquid) was poured into the stainless steel cup, and the pump was put in action to perform ultrafiltration. At the point when a filtrate derived from the module was 50 mL, 950 mL of distilled water was added into the stainless steel cup to perform washing. After the washing treatment was repeated 10 times, the dispersion liquid was condensed until the amount of the mother liquor was 50 mL.

The diameter, major axis length, and appropriate wiring rate of the resulting sample 101, the coefficient of valuation in diameter of silver nanowire, and the degree of sharpness of the cross-sectional angles of silver nanowire of the resulting sample 101 are shown in Table 1.

Production Example 2

Production of Silver Nanowire Aqueous Dispersion Sample 102

A silver nanowire aqueous dispersion of Sample 102 was produced in a similar manner to that described in Production Example 1, except that the initial temperature of the mixture solution in the first step was changed from 20° C. to 25° C.

The diameter, major axis length, and appropriate wiring rate of the resulting sample 102, the coefficient of valuation in diameter of silver nanowire, and the degree of sharpness of the cross-sectional angles of silver nanowire of the resulting sample 102 are shown in Table 1.

Production Example 3

Production of Silver Nanowire Aqueous Dispersion Sample 103

A silver nanowire aqueous dispersion of Sample 103 was produced in a similar manner to that described in Production Example 1, except that the initial temperature of the mixture solution in the first step was changed from 20° C. to 30° C.

The diameter, major axis length, and appropriate wiring rate of the resulting sample 103, the coefficient of valuation in diameter of silver nanowire, and the degree of sharpness of the cross-sectional angles of silver nanowire of the resulting sample 103 are shown in Table 1.

Production Example 4

Production of Silver Nanowire Aqueous Dispersion Sample 104

A silver nanowire aqueous dispersion of Sample 104 was produced in a similar manner to that described in Production Example 1, except that the amount of the additive liquid H added in the first step was changed from 82.5 mL to 70.0 mL.

The diameter, major axis length, and appropriate wiring rate of the resulting sample 104, the coefficient of valuation in diameter of silver nanowire, and the degree of sharpness of the cross-sectional angles of silver nanowire of the resulting sample 104 are shown in Table 1.

Production Example 5

Production of Silver Nanowire Aqueous Dispersion Sample 105

A silver nanowire aqueous dispersion of Sample 105 was produced in a similar manner to that described in Production Example 1, except that the amount of the additive liquid H added in the first step was changed from 82.5 mL to 65.0 mL.

The diameter, major axis length, and appropriate wiring rate of the resulting sample 105, the coefficient of valuation in diameter of silver nanowire, and the degree of sharpness of the cross-sectional angles of silver nanowire of the resulting sample 105 are shown in Table 1.

Production Example 6

Production of Silver Nanowire Aqueous Dispersion Sample 106

A silver nanowire aqueous dispersion of Sample 106 was produced in a similar manner to that described in Production Example 1, except that the addition flow rate of the additive liquid A was changed from 2.0 mL/min to 4.0 mL/min.

The diameter, major axis length, and appropriate wiring rate of the resulting sample 106, the coefficient of valuation in diameter of silver nanowire, and the degree of sharpness of the cross-sectional angles of silver nanowire of the resulting sample 106 are shown in Table 1.

Production Example 7

Production of Silver Nanowire Aqueous Dispersion Sample 107

A silver nanowire aqueous dispersion of Sample 107 was produced in a similar manner to that described in Production Example 1, except that the addition flow rate of the additive liquid A was changed from 2.0 mL/min to 6.0 mL/min.

The diameter, major axis length, and appropriate wiring rate of the resulting sample 107, the coefficient of valuation in diameter of silver nanowire, and the degree of sharpness of the cross-sectional angles of silver nanowire of the resulting sample 107 are shown in Table 1.

Production Example 8

Production of Silver Nanowire Aqueous Dispersion Sample 108

A silver nanowire aqueous dispersion of Sample 108 was produced in a similar manner to that described in Production Example 1, except that the temperature of the inside system in the second step was raised from 75° C. by 1.5° C. increments at every one-hour interval.

The diameter, major axis length, and appropriate wiring rate of the resulting sample 108, the coefficient of valuation in diameter of silver nanowire, and the degree of sharpness of the cross-sectional angles of silver nanowire of the resulting sample 108 are shown in Table 1.

Production Example 9

Production of Silver Nanowire Aqueous Dispersion Sample 109

A silver nanowire aqueous dispersion of Sample 109 was produced in a similar manner to that described in Production Example 1, except that the temperature of the inside system in the second step was raised from 75° C. by 2.5° C. increments at every one-hour interval.

The diameter, major axis length, and appropriate wiring rate of the resulting sample 109, the coefficient of valuation in diameter of silver nanowire, and the degree of sharpness of the cross-sectional angles of silver nanowire of the resulting sample 109 are shown in Table 1.

Production Example 10

Production of Silver Nanowire Aqueous Dispersion Sample 110

A silver nanowire aqueous dispersion of Sample 110 was produced in a similar manner to that described in Production Example 1, except that the temperature of the inside system in the second step was maintained at 80° C.

The diameter, major axis length, and appropriate wiring rate of the resulting sample 110, the coefficient of valuation in diameter of silver nanowire, and the degree of sharpness of the cross-sectional angles of silver nanowire of the resulting sample 110 are shown in Table 1.

Production Example 11

Production of Silver Nanowire Aqueous Dispersion Sample 111

A silver nanowire aqueous dispersion of Sample 111 was produced in a similar manner to that described in Production Example 1, except that the temperature of the inside system in the second step was maintained at 90° C.

The diameter, major axis length, and appropriate wiring rate of the resulting sample 111, the coefficient of valuation in diameter of silver nanowire, and the degree of sharpness of the cross-sectional angles of silver nanowire of the resulting sample 111 are shown in Table 1.

Production Example 12

Production of Silver Nanowire Aqueous Dispersion Sample 112

A silver nanowire aqueous dispersion of Sample 112 was produced in a similar manner to that described in Production Example 1, except that the temperature of the inside system in the second step was raised from 75° C. by 3.5° C. increments at every one-hour interval.

The diameter, major axis length, and appropriate wiring rate of the resulting sample 112, the coefficient of valuation in diameter of silver nanowire, and the degree of sharpness of the cross-sectional angles of silver nanowire of the resulting sample 112 are shown in Table 1.

Production Example 13

Production of Silver Nanowire Aqueous Dispersion Sample 113

A silver nanowire aqueous dispersion of Sample 113 was produced in a similar manner to that described in Production Example 1, except that the temperature of the inside system in the second step was maintained at 95° C.

The diameter, major axis length, and appropriate wiring rate of the resulting sample 113, the coefficient of valuation in diameter of silver nanowire, and the degree of sharpness of the cross-sectional angles of silver nanowire of the resulting sample 113 are shown in Table 1.

Production Example 14

Production of Silver Nanowire Aqueous Dispersion Sample 201

A silver nanowire aqueous dispersion of Sample 201 was produced in a similar manner to that described in Production Example 1, except that the initial temperature of the mixture solution in the first step was changed from 20° C. to 40° C.

The diameter, major axis length, and appropriate wiring rate of the resulting sample 201, the coefficient of valuation in diameter of silver nanowire, and the degree of sharpness of the cross-sectional angles of silver nanowire of the resulting sample 201 are shown in Table 1.

Production Example 15

Production of Silver Nanowire Aqueous Dispersion Sample 202

A silver nanowire aqueous dispersion of Sample 202 was produced in a similar manner to that described in Production Example 1, except that the amount of the additive liquid H added in the first step was changed from 82.5 mL to 50.0 mL.

The diameter, major axis length, and appropriate wiring rate of the resulting sample 202, the coefficient of valuation in diameter of silver nanowire, and the degree of sharpness of the cross-sectional angles of silver nanowire of the resulting sample 202 are shown in Table 1.

Production Example 16

Production of Silver Nanowire Aqueous Dispersion Sample 203

A silver nanowire aqueous dispersion of Sample 203 was produced in a similar manner to that described in Production Example 1, except that the addition flow rate of the additive liquid A was changed from 2.0 mL/min to 8.0 mL/min.

The diameter, major axis length, and appropriate wiring rate of the resulting sample 203, the coefficient of valuation in diameter of silver nanowire, and the degree of sharpness of the cross-sectional angles of silver nanowire of the resulting sample 203 are shown in Table 1.

TABLE 1

| | Sample No. | Diameter of wire (nm) | Major axis length of wire (μm) | Appropriate wiring rate (% by mass) | Coefficient of variation in diameter of wire (%) | Degree of sharpness of cross-sectional angles (%) |
|---|---|---|---|---|---|---|
| Production Ex. 1 | 101 | 17.6 | 36.7 | 82.6 | 18.3 | 47.3 |
| Production Ex. 2 | 102 | 23.8 | 41.8 | 78.3 | 29.3 | 37.3 |
| Production Ex. 3 | 103 | 48.3 | 32.3 | 62.7 | 33.4 | 43.4 |
| Production Ex. 4 | 104 | 16.2 | 13.7 | 76.3 | 22.3 | 48.1 |
| Production Ex. 5 | 105 | 17.8 | 6.8 | 63.2 | 27.4 | 58.3 |
| Production Ex. 6 | 106 | 19.4 | 41.8 | 71.7 | 24.3 | 45.3 |
| Production Ex. 7 | 107 | 16.3 | 32.4 | 58.4 | 28.4 | 49.2 |
| Production Ex. 8 | 108 | 19.2 | 37.5 | 78.3 | 33.7 | 42.3 |
| Production Ex. 9 | 109 | 18.3 | 34.2 | 67.3 | 38.2 | 47.2 |
| Production Ex. 10 | 110 | 16.3 | 28.3 | 77.2 | 22.7 | 57.4 |
| Production Ex. 11 | 111 | 18.2 | 26.3 | 62.7 | 31.2 | 68.3 |
| Production Ex. 12 | 112 | 16.3 | 12.7 | 58.2 | 45.4 | 46.1 |
| Production Ex. 13 | 113 | 18.2 | 13.7 | 77.6 | 38.1 | 89.4 |
| Production Ex. 14 | 201 | 62.4 | 34.6 | 68.4 | 43.4 | 32.7 |
| Production Ex. 15 | 202 | 18.2 | 3.7 | 54.2 | 27.4 | 37.2 |
| Production Ex. 16 | 203 | 19.2 | 13.2 | 28.3 | 38.1 | 43.2 |

<Formation of Undercoat Layer>

Next, a commercially available biaxially stretched and heat fixed polyethylene terephthalate (PET) substrate having a thickness of 100 μm was subjected to a corona discharging treatment at 8 W/m$^2$·min, and the following undercoat layer composition was applied onto the substrate so that the dry thickness of the resulting undercoat layer was 0.8 μm.

—Composition of Undercoat Layer—

Composition of undercoat layer: 0.5% by mass of hexamethylene-1,6-bis(ethylene urea) is contained in a latex copolymer containing butyl acrylate (40% by mass), styrene (20% by mass), glycidyl acrylate (40% by mass)

Example 1

Production of Coating Sample 301

A surface of the undercoat layer was subjected to a corona discharging treatment at 8 W/m$^2$·min, and hydroxyethyl cellulose was applied to the surface to form a hydrophilic polymer layer so that the dry thickness was 0.2 μm.

Subsequently, the aqueous dispersion sample 101 was applied onto the hydrophilic polymer layer using a doctor coater and dried. The coating amount of silver was measured by an X-ray fluorescence spectrometer (SEA1100, manufactured by SII Corp.) and adjusted so as to be 0.015 g/m$^2$, thereby producing a coating sample 301.

—Production of Coating Samples 302 to 308—

Next, Coating Samples 302 to 308 were produced in a similar manner as that described in Sample 301, except that before coating, a solution in which the heterocyclic compound shown in Table 2 has been dissolved in a water/methanol solution was added to the metal nanowire aqueous dispersion liquid whose temperature was maintained at 40° C. and stirred for 10 minutes.

Example 2

Production of Coating Samples 402 to 408

Coating Samples 402 to 408 were produced in a similar manner to that described in Coating Sample 301, except that the sample that had undergone coating treatment was immersed for 10 minutes in a water/methanol solution whose temperature was maintained at 25° C., in which the heterocyclic compound as shown in Table 3 had been dissolved Example 3

Production of Coating Samples 501 to 508

Coating Sample 501 was produced in a similar manner to that described in Coating Sample 301, except that the aqueous dispersion sample 101 was replaced with the aqueous dispersion sample 201.

Further, Coating Samples 502 to 508 were obtained in a similar manner to that described in Coating Sample 501, except that a solution in which the heterocyclic compound shown in Table 4 has been dissolved in a water/methanol solution was added to the metal nanowire aqueous dispersion liquid whose temperature was maintained at 40° C. and stirred for 10 minutes.

Subsequently, the resulting coating samples were each evaluated for their physical properties. The evaluation results are shown in Tables 2 to 4.

<Transmittance of Coating Sample>

The transmittance of the resulting respective coating samples at a wavelength of 400 nm to 800 nm was measured by a UV-2550 manufactured by Shimadzu Corporation.

[Evaluation Criteria]

A: The transmittance was 90% or more, which was on a practically trouble-free level.

B: The transmittance was 80% or more and less than 90%, which was on a practically trouble-free level.

C: The transmittance was 75% or more and less than 80%, which was on a practically trouble-free level.

D: The transmittance was 0% or more and less than 70%, which was on a problematic level in practical use.

<Surface Resistivity (Conductivity) of Coating Sample>

The surface resistivity of the resulting respective coating samples was measured by LORESTA-GP MCP-T600 manufactured by Mitsubishi Chemical Co., Ltd., and the results were evaluated based on the following criteria.

[Evaluation Criteria]

A: The surface resistivity was less than 100 Ω/square, which was on a practically trouble-free level.

B: The surface resistivity was less than 500 Ω/square, which was on a practically trouble-free level.

C: The surface resistivity was less than 1,000 Ω/square, which was on a practically trouble-free level.

D: The surface resistivity was more than 1,000 Ω/square, which was on a problematic level in practical use.

<Thermal Stability Test on Coating Sample>

The resulting respective coating samples were left in the air at a temperature of 80° C. and at a relative humidity (RH) of 55% for 4 weeks. Afterwards, the respective samples were evaluated for thermal stability based on the results of the measurements of surface resistivity and transmittance.

TABLE 2

| Coating sample | Wire dispersion | Heterocyclic | EAg | Added amount | Immediate after coating | | After thermal stability test | | |
|---|---|---|---|---|---|---|---|---|---|
| No. | sample | compound | [mV] | [mol/molAg] | Transparency | Conductivity | Transparency | Conductivity | Remark |
| 301 | Sample 101 | — | — | — | A | A | C | D | Comparative Example |
| 302 | Sample 101 | Comparative compound A | −1 | $1 \times 10^{-3}$ | A | A | C | D | Comparative Example |
| 303 | Sample 101 | Comparative compound B | 57 | $1 \times 10^{-3}$ | A | A | C | D | Comparative Example |
| 304 | Sample 101 | at-12 | −152 | $1 \times 10^{-3}$ | A | A | B | B | Present Invention |
| 305 | Sample 101 | at-20 | −230 | $1 \times 10^{-3}$ | A | A | A | B | Present Invention |
| 306 | Sample 101 | at-21 | −240 | $1 \times 10^{-3}$ | A | A | A | A | Present Invention |
| 307 | Sample 101 | at-11 | −96 | $1 \times 10^{-3}$ | A | A | A | A | Present Invention |
| 308 | Sample 101 | at-19 | −520 | $1 \times 10^{-3}$ | A | B | A | A | Present Invention |

TABLE 3

| Coating sample | Wire dispersion | Heterocyclic | EAg | Concentration of immersion liquid | Immediate after coating | | After thermal stability test | | |
|---|---|---|---|---|---|---|---|---|---|
| No. | sample | compound | [mV] | [%] | Transparency | Conductivity | Transparency | Conductivity | Remark |
| 301 | Sample 101 | — | — | — | A | A | C | D | Comparative Example |
| 402 | Sample 101 | Comparative compound A | −1 | 1 | A | A | C | D | Comparative Example |
| 403 | Sample 101 | Comparative compound B | 57 | 1 | A | A | C | D | Comparative Example |
| 404 | Sample 101 | at-12 | −152 | 1 | A | A | B | B | Present Invention |
| 405 | Sample 101 | at-20 | −230 | 1 | A | A | A | B | Present Invention |
| 406 | Sample 101 | at-21 | −240 | 1 | A | A | A | A | Present Invention |
| 407 | Sample 101 | at-11 | −96 | 1 | A | A | A | A | Present Invention |
| 408 | Sample 101 | at-19 | −520 | 1 | A | B | A | A | Present Invention |

TABLE 4

| Coating sample No. | Wire dispersion sample | Heterocyclic compound | EAg [mV] | Added amount [mol/molAg] | Immediate after coating Transparency | Immediate after coating Conductivity | After thermal stability test Transparency | After thermal stability test Conductivity | Remark |
|---|---|---|---|---|---|---|---|---|---|
| 501 | Sample 201 | — | — | — | C | A | C | D | Comparative Example |
| 502 | Sample 201 | Comparative compound A | −1 | $1 \times 10^{-3}$ | C | A | C | D | Comparative Example |
| 503 | Sample 201 | Comparative compound B | 57 | $1 \times 10^{-3}$ | C | A | C | D | Comparative Example |
| 504 | Sample 201 | at-12 | −152 | $1 \times 10^{-3}$ | C | A | C | B | Present Invention |
| 505 | Sample 201 | at-20 | −230 | $1 \times 10^{-3}$ | C | A | C | B | Present Invention |
| 506 | Sample 201 | at-21 | −240 | $1 \times 10^{-3}$ | C | A | C | A | Present Invention |
| 507 | Sample 201 | at-11 | −96 | $1 \times 10^{-3}$ | C | A | C | A | Present Invention |
| 508 | Sample 201 | at-19 | −520 | $1 \times 10^{-3}$ | C | A | C | A | Present Invention |

With respect to the heterocyclic compound shown in Tables 2 to 4, a compound represented by any of the following structural formulas was used. The term "EAg" means an interaction potential of silver.

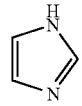

Comparative compound A
EAg: -1 mV

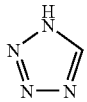

Comparative compound B
EAg: 57 mV

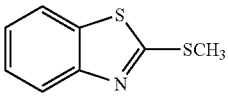

(at-11)
EAg: -96 mV

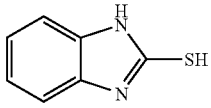

(at-12)
EAg: -152 mV

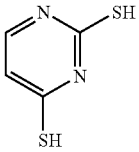

(at-19)
EAg: -520 mV

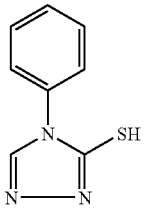

(at-20)
EAg: -230 mV

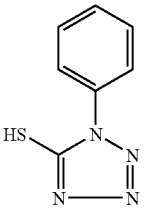

(at-21)
EAg: -240 mV

Since the metal nanowire-containing composition of the present invention has improved in thermal stability without impairing its excellent transparency, conductivity and durability, it can be widely used in touch panels, antistatic displays, electromagnetic shields, electrodes for organic or inorganic EL display, electron paper, electrodes for flexible-display, antistatic panels for flexible display, solar cell panels, and various other devices.

What is claimed is:

1. A metal nanowire-containing composition comprising:

a metal nanowire, and a heterocyclic compound, wherein a coefficient of variation in diameter of the metal nanowire is 30% or less, and wherein the heterocyclic compound is one of the compounds represented by the following formulae (at-20) to (at-21):

(at-20)

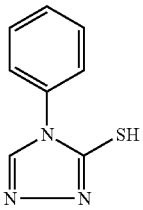

(at-21)

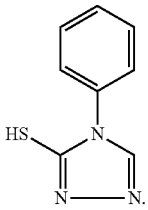

2. The metal nanowire-containing composition according to claim 1, wherein the metal nanowire has a diameter of 50 nm or less, a length of 5 μm or longer, and the metal nanowire is contained in an amount, as metal, of 50% by mass or more in the total amount of metal particles.

3. The metal nanowire-containing composition according to claim 1, wherein the metal nanowire contains silver.

4. The metal nanowire-containing composition according to claim 1, further comprising an aqueous solvent, and being in the form of an aqueous dispersion.

5. The metal nanowire-containing composition according to claim 1, wherein the diameter of the metal nanowire is in the range of 5 nm to 35 nm.

6. The metal nanowire-containing composition according to claim 1, wherein the metal nanowire is produced by adding a silver ammonia complex solution into an aqueous solution containing at least a halogen compound and a reducing sugar.

* * * * *

UNITED STATES PATENT AND TRADEMARK OFFICE

CERTIFICATE OF CORRECTION

PATENT NO. : 8,883,045 B2
APPLICATION NO. : 12/570143
DATED : November 11, 2014
INVENTOR(S) : Yoichi Hosoya et al.

It is certified that error appears in the above-identified patent and that said Letters Patent is hereby corrected as shown below:

Title Page

"(73) Assignee: Fujifilm Corporation, Tokyo (JP)"

should be replaced with

--(73) Assignee: FUJIFILM Corporation, Tokyo (JP)--.

Signed and Sealed this
Nineteenth Day of May, 2015

Michelle K. Lee

Michelle K. Lee
*Director of the United States Patent and Trademark Office*